US008781361B2

(12) United States Patent
Jang et al.

(10) Patent No.: US 8,781,361 B2
(45) Date of Patent: Jul. 15, 2014

(54) IMAGE FORMING APPARATUS

(75) Inventors: Ho-jin Jang, Suwon-si (KR); Hyun-wook Bae, Yongin-si (KR); Seung-gweon Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 73 days.

(21) Appl. No.: 13/585,464

(22) Filed: Aug. 14, 2012

(65) Prior Publication Data

US 2013/0129381 A1 May 23, 2013

(30) Foreign Application Priority Data

Nov. 22, 2011 (KR) ..... 10-2011-0122532

(51) Int. Cl.
*G03G 21/18* (2006.01)
*G03G 15/00* (2006.01)

(52) U.S. Cl.
USPC ..... 399/115; 399/393

(58) Field of Classification Search
USPC ..... 399/110, 111, 115, 393
See application file for complete search history.

(56) References Cited

FOREIGN PATENT DOCUMENTS

JP 06202404 A * 7/1994
JP 2007322873 A * 12/2007

* cited by examiner

*Primary Examiner* — David Gray
*Assistant Examiner* — Erika J Villaluna
(74) *Attorney, Agent, or Firm* — Stanzione & Kim, LLP

(57) ABSTRACT

An image forming apparatus includes a main body of the image forming apparatus; a developing cartridge that is detachably disposed in the main body and includes an image carrier; a charging roller that is disposed to face the image carrier in the developing cartridge and charges a surface of the image carrier; a charging roller separating unit that moves the charging roller between a first position in which the charging roller is in contact with the image carrier and a second position in which the charging roller is spaced apart from the image carrier; and a paper feeding cassette detachably disposed in the main body; wherein when the paper feeding cassette is first mounted, the charging roller is fixed in the second position by the charging roller separating unit.

21 Claims, 15 Drawing Sheets

IMAGE FORMING APPARATUS

CROSS-REFERENCE TO RELATED APPLICATIONS

This application claims the benefit under 35 U.S.C. §119 (a) from Korean Patent Application No. 2011-122532 filed Nov. 22, 2011 in the Korean Intellectual Property Office, the disclosure of which is incorporated herein by reference in its entirety.

BACKGROUND

1. Field

The present disclosure relates to an image forming apparatus. More particularly, the present disclosure relates to an image forming apparatus that may be distributed in a state that a charging roller thereof is spaced apart from an image carrier thereof.

2. Description of the Related Art

Generally, electro-photographic image forming apparatuses, such as laser printers, facsimile machines, copy machines, composite apparatuses or the like, form a predetermined electrostatic latent image on an image carrier. After that, the image forming apparatus develops the electrostatic latent image on the image carrier with developer, transfers a developer image onto a printing medium and fuses the developer image onto the printing medium, thereby performing a printing.

The image forming apparatus includes an image carrier, an outer circumferential surface of which is evenly charged by a charging member, an exposure unit that emits light to the image carrier to form an electrostatic latent image, and a developing member that supplies developer to the image carrier to develop the electrostatic latent image into a developer image.

A method of evenly charging the outer circumferential surface of the image carrier through the charging member may be classified into a corona discharging method and a close charging method. The close charging method is a method of allowing a roller or a blade to be in contact with the image carrier and generating electric discharges in infinitesimal gaps between the image carrier and the roller or the blade to charge the image carrier. The corona discharge method has a problem that ozone is generated during ionization of the air. Therefore, at present, the close discharging method is widely used.

Specially, a roller contact charging method that is similar to the close discharging method is widely used. The roller contact discharging method is a method of causing a charging roller to be in contact with the image carrier with a predetermined pressure to charge the outer circumferential surface of the image carrier.

If the charging roller has prolonged contact with the image carrier under a predetermined pressure, quality problems such as compression set, migration, and the like, may occur in the charging roller. The compression set refers to a phenomenon that a contact portion of the charging roller which is in contact with, and is pressed by, the image carrier for an extended period of time is not restored to its original state. The migration refers to a phenomenon that substances contained in the charging roller come out of the charging roller, and are transferred to, and adhered onto, the image carrier due to heat and pressure generated by prolonged contact between the charging roller and the image carrier.

If the above-described phenomenon occurs, when a user prints output, horizontal stripes are formed on the printed image at a rotation cycle of the charging roller and/or at a rotation cycle of the outer circumferential surface of the image carrier to cause a poor image. To prevent this phenomenon, while the image forming apparatus is being distributed for sale after manufacture, the charging roller and the image carrier should not be kept in contact with each other.

To keep the charging roller and the image carrier spaced apart from each other during distribution, a special spacing member may be inserted between the charging roller and the image carrier to maintain therebetween a non-contact state, and then, the image forming apparatus having the special spacing member may be distributed. Thus, after buying the image forming apparatus, a user removes the special spacing member from a developing cartridge, mounts the developing cartridge into a main body of the image forming apparatus, and uses the image forming apparatus to print. However, this method may solve the migration problem, but may not solve the compression set problem. Also, this method has an inconvenience in that the user removes the special spacing member.

Alternatively, the charging roller may be configured to be spaced apart from the image carrier by spacing members disposed at opposite ends of the charging roller. In this case, when the image carrier is driven, the spacing members are rotated so that the charging roller and the image carrier are automatically in contact with each other. However, since this method needs a specific jig to cause a projection of the spacing member to face the image carrier, a manufacturing process is complex. Also, during distribution, due to impact or vibration the spacing member rotates by itself so that the charging roller comes in contact with the image carrier.

Accordingly, there is a need to provide an image forming apparatus that may prevent chemical and physical deformation from being generated in a contact portion between the image carrier and the charging roller due to leaving the image forming apparatus alone for an extended period of time and a variety of different temperatures and humidity environments during distribution.

SUMMARY

The present general inventive concept has been developed to overcome the above drawbacks and other problems associated with the conventional arrangement. A feature of the present general inventive concept is related to an image forming apparatus having a structure in which a charging roller is required to be spaced apart from an image carrier to solve problems generated during distribution in a state when the charging roller is in contact with the image carrier.

Additional features and utilities of the present general inventive concept will be set forth in part in the description which follows and, in part, will be obvious from the description, or may be learned by practice of the general inventive concept.

The above features and/or other utilities of the present disclosure may substantially be achieved by providing an image forming apparatus, which may include a main body of the image forming apparatus; a developing cartridge that is detachably disposed in the main body and includes an image carrier; a charging roller that is disposed to face the image carrier in the developing cartridge and charges a surface of the image carrier; a charging roller separating unit that moves the charging roller between a first position in which the charging roller is in contact with the image carrier and a second position in which the charging roller is spaced apart from the image carrier; and a paper feeding cassette detachably disposed in the main body; wherein when the paper feeding cassette is first mounted, the charging roller is fixed in the second position by the charging roller separating unit.

If the paper feeding cassette is separated from the main body or mounted in the main body in a state that the paper feeding cassette does not interfere with the charging roller separating unit, the charging roller is positioned at the first position.

The charging roller separating unit may include a link member connected to the charging roller; and a lever member that is disposed in the main body so that the link member is hooked to the lever member and is rotated by mounting and separating the paper feeding cassette.

A lever fixing member may be disposed on the paper feeding cassette to support a bottom end of the lever member.

The paper feeding cassette may be formed to be foldable.

If the paper feeding cassette is mounted into the main body in a folded state, the lever fixing member supports the bottom end of the lever member so that the lever member is fixed perpendicular to the paper feeding cassette, and if the paper feeding cassette is mounted into the main body in an extended state, the lever fixing member does not support the lever member so that the lever member may freely rotate.

A hooking part may be formed on one end portion of the link member to be hooked to the top end of the lever member, and the other end portion of the link member may be fixed to one end of a shaft of the charging roller.

A fixing cap may be disposed on the one end of the shaft of the charging roller, and the other end of the link member may be fixed to the fixing cap.

The developing cartridge may support opposite ends of the charging roller and include a charging roller holder to press the charging roller toward the image carrier.

The charging roller holder may include a pressure member.

A through hole through which the one end of the lever member passes and that limits rotation of the lever member may be formed on one side of the frame of the main body.

The developing cartridge may include a guiding member that guides movement of the link member.

If the paper feeding cassette is mounted into the main body, the lever fixing member supports the bottom end of the lever member so that the lever member is fixed perpendicular to the paper feeding cassette.

The foregoing and/or other features and utilities of the present general inventive concept may be also be achieved by including, among other things, an image forming apparatus that includes a main body of the image forming apparatus; a multi-position charging-developing unit including at least an image carrier and a charging roller and controlling contact therebetween; and a paper feeding cassette detachably disposed in the main body, arranged, when the paper feeding cassette is first mounted, to fix the charging roller in a spaced apart position from the image carrier.

Other features, and salient utilities of the present general inventive concept will become apparent from the following detailed description, which, taken in conjunction with the annexed drawings, describes exemplary embodiments.

BRIEF DESCRIPTION OF THE DRAWINGS

These and/or other features and utilities of the present general inventive concept will become apparent and more readily appreciated from the following description of the embodiments, taken in conjunction with the accompanying drawings of which.

These and/or other features and utilities of the present general inventive concept will become apparent and more readily appreciated from the following description of the embodiments, taken in conjunction with the accompanying drawings of which.

Throughout the drawings, like reference numerals will be understood to refer to like parts, components and structures.

DETAILED DESCRIPTION OF THE EXEMPLARY EMBODIMENTS

Figure 1:
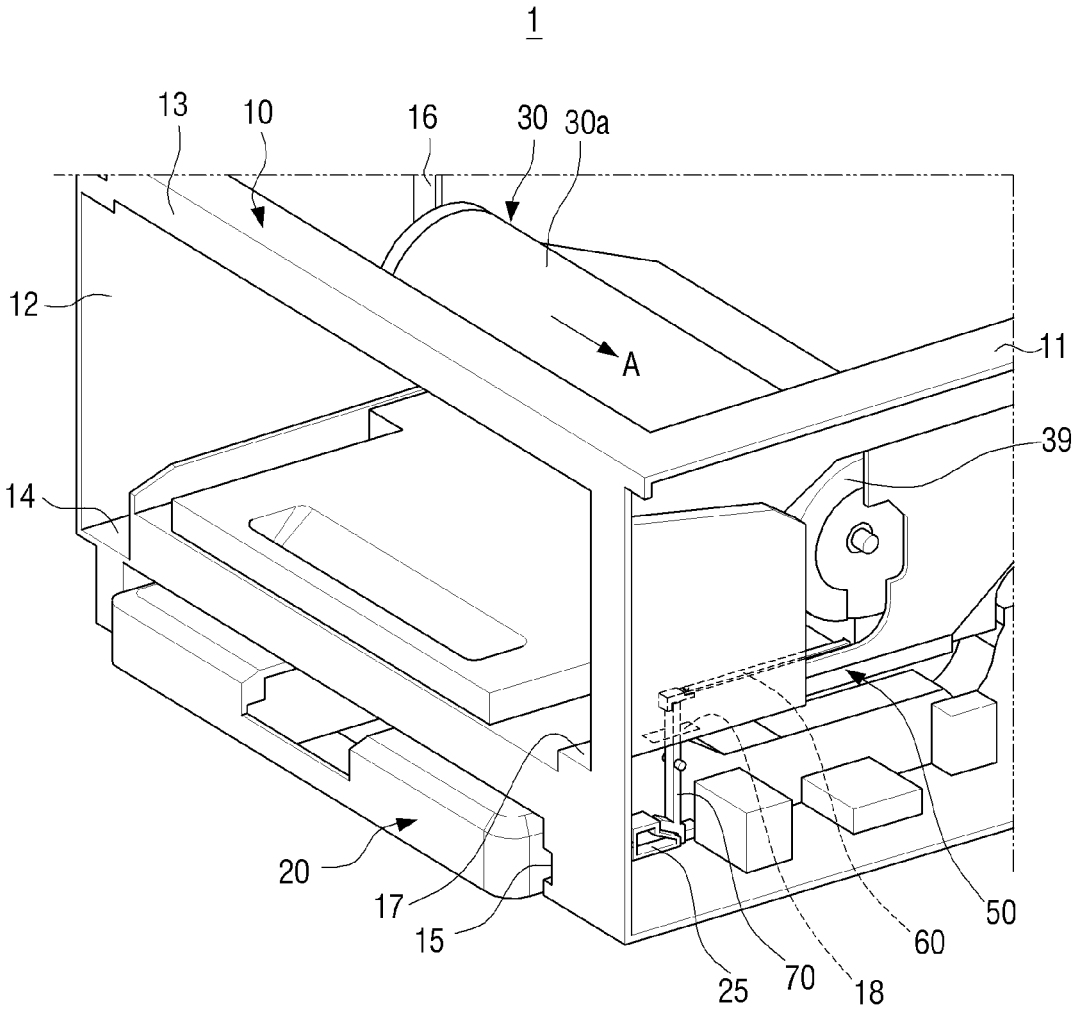
FIG. 1 is a partially perspective view illustrating an image forming apparatus according to an exemplary embodiment of the present general inventive concept having a charging roller and an image carrier separated from each other.

Reference will now be made in detail to the exemplary embodiments of the present general inventive concept, examples of which are illustrated in the accompanying drawings, wherein like reference numerals refer to the like elements throughout. The exemplary embodiments are described below in order to explain the present general inventive concept while referring to the figures.

The matters defined herein, such as a detailed construction and elements thereof, are provided to assist in a comprehensive understanding of this description. Thus, it is apparent that exemplary embodiments may be carried out without those defined matters. Also, well-known functions or constructions are omitted to provide a clear and concise description of exemplary embodiments. Further, dimensions of various elements in the accompanying drawings may be arbitrarily increased or decreased to assist in a comprehensive understanding.

Figure 2:
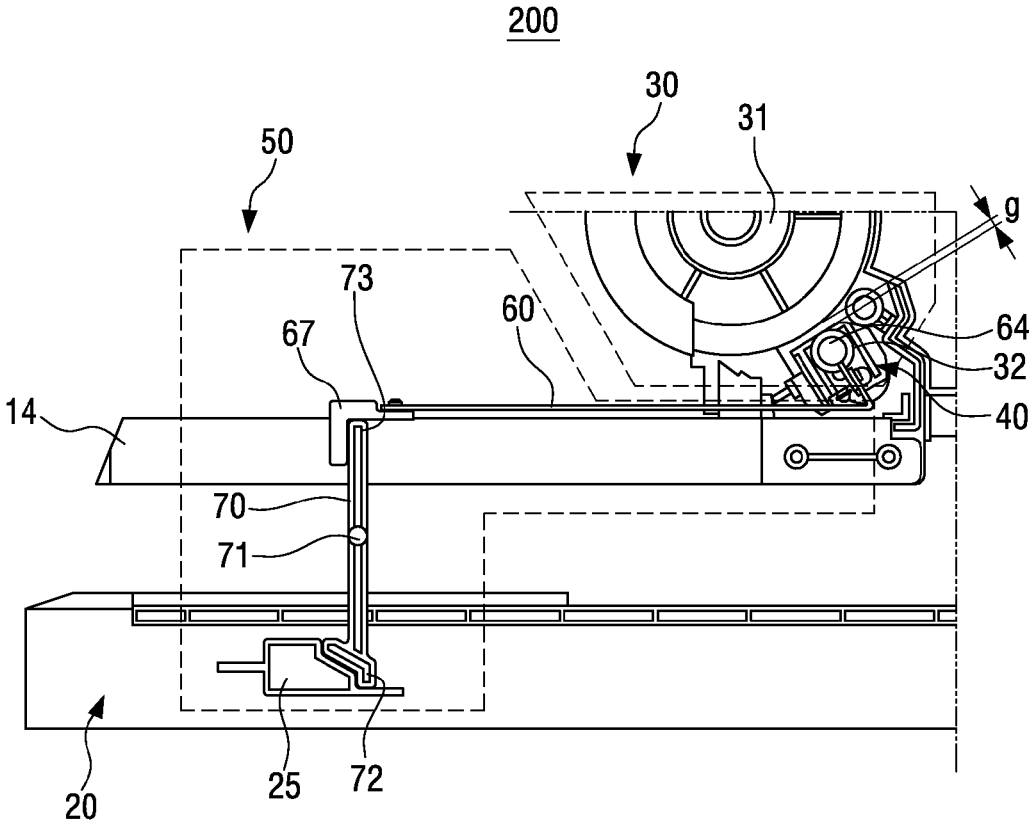
FIG. 2 is a side view illustrating the image forming apparatus of FIG. 1 in which a right frame is removed to show a relationship between a link member and a lever member.

FIG. 1 is a partial perspective view illustrating an image forming apparatus according to an exemplary embodiment of the present general inventive concept having a charging roller and an image carrier separated from each other. FIG. 2 is a side view illustrating the image forming apparatus of FIG. 1, a right frame of which is removed to show a relationship between a link member and a lever member.

In FIG. 1, to clearly show operation of a lever member 70, a link member 60, a lever fixing member 25, and the like are disposed inside the image forming apparatus 1. Various covers, a fusing unit, an exposure unit, and the like may be disposed in a main body 10 of the image forming apparatus 1. However, a frame of the main body 10, a developing cartridge 30, and a paper feeding cassette 20 are illustrated. Also, FIG. 2 illustrates the developing cartridge 30 from which a right side wall 39 of housing 30*a* is removed.

Referring to FIGS. 1 and 2, the image forming apparatus 1 may include the main body 10, the paper feeding cassette 20, the developing cartridge 30, and a charging roller separating unit 50.

The main body 10 accumulates and supports the developing cartridge 30 and the paper feeding cassette 20. The developing cartridge 30 and the paper feeding cassette 20 are detachably disposed in the main body 10. The main body 10 includes a left frame 12 and a right frame 11. The left and right frames 12 and 11 are spaced apart by a predetermined distance "g" from each other and secured by a top frame 13 and a bottom frame 14. A cassette space 15 into which the paper feeding cassette 20 is inserted is formed below the bottom frame 14. The left and right frames 12 and 11 of the main body 10 are provided with a cartridge mounting portion 16 onto which the developing cartridge 30 including an image carrier 31 and a charging roller 32 is mounted. Accordingly, when the developing cartridge 30 is mounted onto the cartridge mounting portion 16, the developing cartridge 30 is fixed to a predetermined position inside the main body 10. In this exemplary embodiment, a case in which the image carrier 31 and the charging roller 32 are disposed in the developing cartridge 30 that may be separated from the main body 10 is explained below. However, the image carrier 31 and the charging roller 32 may be directly disposed in the main body 10.

As illustrated in FIGS. 1 and 2, in an exemplary embodiment of the present general inventive concept, an image forming apparatus 1 may include a main body 10 of the image forming apparatus; a multi-position charging-developing unit 200 including at least an image carrier 31 and a charging roller 32. The multi-position charging-developing unit 200 may control contact between the image carrier 31 and the charging roller 32.

The multi-position charging-developing unit 200 may further include a paper feeding cassette 20 detachably disposed in the main body 10. When the paper feeding cassette 20 is first mounted, the paper feeding cassette 20 is arranged to fix the charging roller 32 in a spaced apart position from the image carrier 31.

The multi-position charging-developing unit 200 may further include a developing cartridge 30 and a charging roller holder 40. The developing cartridge 30 is detachably disposed in the main body 10 and may include the image carrier 31 and the charging roller holder 40 that supports the charging roller 32 in a position that faces the image carrier 31 in the developing cartridge 30. Accordingly, when the charging roller 32 is charged, the charging roller 32 charges a surface of the image carrier 31. The multi-position charging-developing unit 200 further includes a charging roller separating unit 50 that moves the charging roller 32 between a contact position in which the charging roller 32 is in contact with the image carrier 31, and the spaced apart position in which the charging roller 32 is spaced apart from the image carrier 31.

Figure 8:
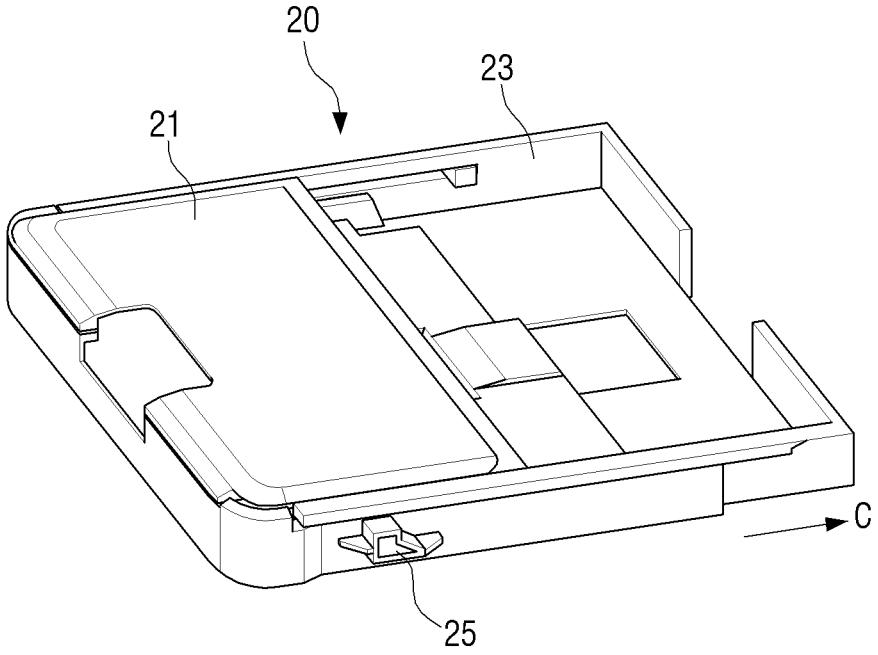
FIG. 8 is a perspective view illustrating a paper feeding cassette of the image forming apparatus of FIG. 1.
Figure 9:
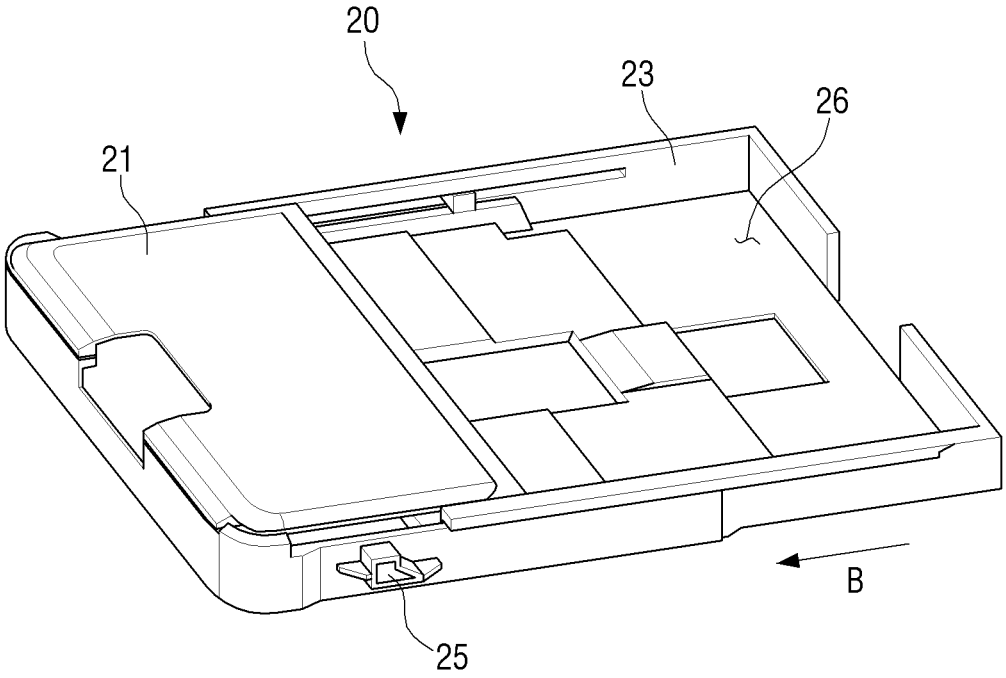
FIG. 9 is a perspective view illustrating when the paper feeding cassette of FIG. 8 is extended.

The paper feeding cassette 20 may store certain sheets of printing media, and is mounted into the cassette space 15 below the bottom frame 14 of the main body 10. The paper feeding cassette 20 is configured to be foldable in a direction to reduce a size of the image forming apparatus 1. FIG. 9 is a perspective view illustrating the paper feeding cassette 20 in a normal state having a loading space 26 which may accommodate standard-size printing media. For example, FIG. 9 illustrates when the paper feeding cassette 20 that may accommodate A4-sized printing media is in a normal state. The paper feeding cassette 20 of FIG. 9 may be folded in a direction of arrow B. For this, the paper feeding cassette 20 may be configured to have a stationary portion 21 and a moving portion 23. A bottom surface and opposite side walls of the moving portion 23 are configured to move with respect to a bottom surface and opposite side walls of the stationary portion 21. Accordingly, in FIG. 9, when the moving portion 23 of the paper feeding cassette 20 is pushed in the direction of arrow B, the length of the paper feeding cassette 20 is reduced. FIG. 8 is a perspective view illustrating the paper feeding cassette 20 having the reduced length, namely, the folded paper feeding cassette 20.

In FIG. 8, when the moving portion 23 of the paper feeding cassette 20 is pulled in a direction of arrow C, the length of the paper feeding cassette 20 is increased to become the state as illustrated in FIG. 9. In other words, the paper feeding cassette 20 according to an exemplary embodiment of the present general inventive concept may be expanded and contracted in the longitudinal direction thereof. When the paper feeding cassette 20 is extended as illustrated in FIG. 9, the paper feeding cassette 20 is used to supply the printing media to the image forming apparatus 1. In other words, when the image forming apparatus 1 is used to print, the paper feeding cassette 20 is extended as illustrated in FIG. 9 and then mounted into the cassette space 15 of the image forming apparatus 1. On the other hand, when the image forming apparatus 1 is distributed, i.e., during shipping, the paper feeding cassette 20 is folded as illustrated in FIG. 8. In other words, when the image forming apparatus 1 is manufactured, a worker folds the paper feeding cassette 20 as illustrated in FIG. 8 and mounts the folded paper feeding cassette 20 into the image forming apparatus 1. As a result, the size of the image forming apparatus 1 may be minimized so that during distribution, packaging and transportation costs thereof may be minimized.

The lever fixing member 25 is disposed on one side wall of the stationary portion 21 of the paper feeding cassette 20. The lever fixing member 25 is formed to support a bottom end 72 of the lever member 70 so that the lever member 70 of the charging roller separating unit 50 as will be described below is fixed perpendicular to the paper feeding cassette 20. If the charging roller separating unit 50 is disposed at each of opposite sides of the main body 10, the lever fixing member 25 is disposed on each of opposite side walls of the paper feeding cassette 20.

The developing cartridge 30 includes the image carrier 31 and the charging roller 32. Light emitted from an exposure unit forms a predetermined electrostatic latent image on the image carrier 31. The developing cartridge 30 may include a developing roller that develops the electrostatic latent image formed on the image carrier 31 and a developer storing portion that accumulates developer to be supplied to the developing roller.

Figure 3:
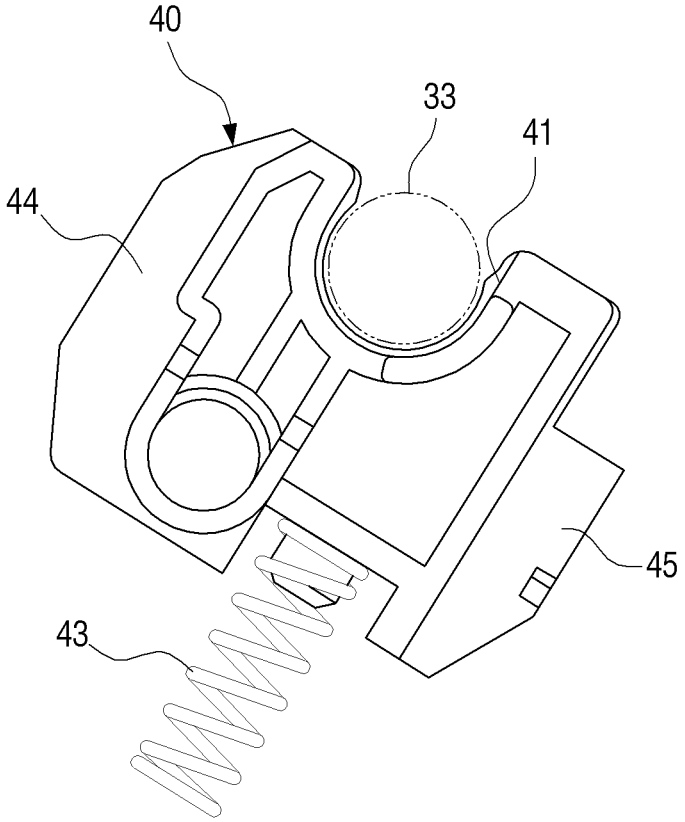
FIG. 3 is a perspective view illustrating a charging roller holder of the image forming apparatus of FIG. 2.

The charging roller 32 is disposed to face the image carrier 31 and to rotate. The charging roller 32 includes a shaft 33 and a roller portion 34 which is disposed on an outer circumference of the shaft 33 to be in contact with the image carrier 31. Opposite ends of the shaft 33 are rotatably supported by charging roller holders 40 as illustrated in FIG. 3.

Figure 7:
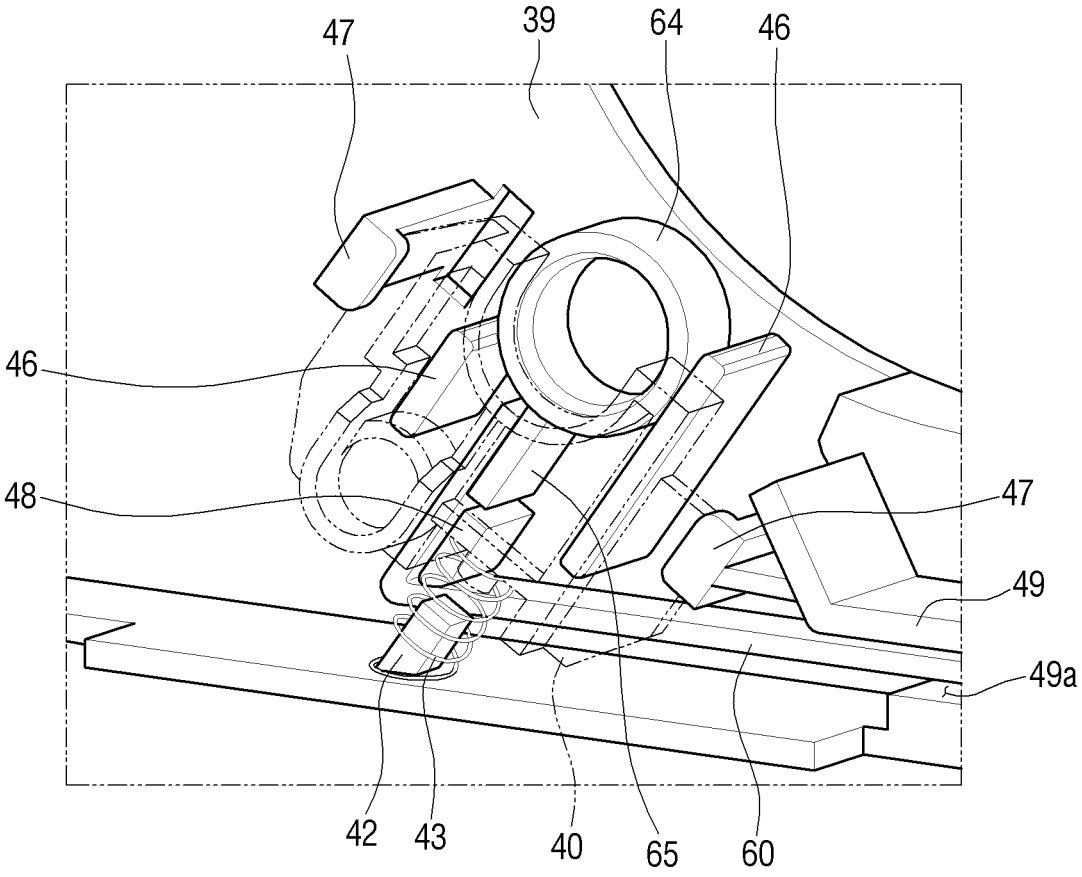
FIG. 7 is a perspective view illustrating a charging roller holder disposed on the right side wall of the developing cartridge of FIG. 6.

A shaft groove 41 that may rotatably support the shaft 33 of the charging roller 32 is formed on a top end of the charging roller holder 40. A pressure member 43 that presses the shaft 33 of the charging roller 32 toward the image carrier 31 is disposed on a bottom end of the charging roller holder 40. A compression coil spring may be used as the pressure member 43. The other end of the pressure member 43, as illustrated in FIG. 7, is fixed to one side wall 39 of the housing 30*a* of the developing cartridge 30. Accordingly, the charging roller 32 always receives a force that is applied toward the image carrier 31 by the pressure member 43.

Figure 6:
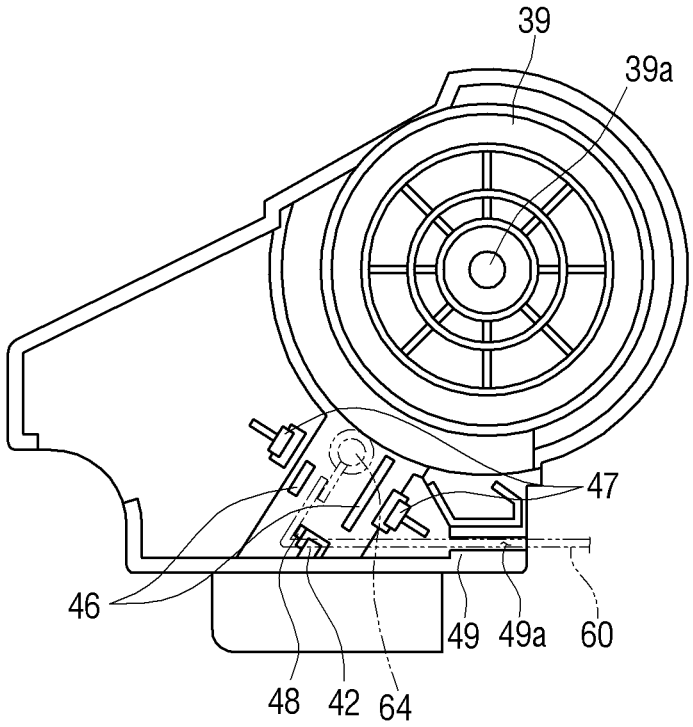
FIG. 6 is a view illustrating a right side wall of an developing cartridge mounted to the image forming apparatus of FIG. 1.

The charging roller holder 40 is disposed inside the housing 30*a* of the developing cartridge 30 and is supported to slidably move by the one side wall 39 of the housing 30*a*. FIG. 6 is a view illustrating a right side wall 39 of the housing 30*a* of the developing cartridge 30 of FIG. 1 viewed in a direction of arrow A in FIG. 1, namely, viewed from the inside of the housing 30*a* of the developing cartridge 30. FIG. 7 is a partial perspective view illustrating the right side wall 39 of the housing 30*a* of the developing cartridge 30 of FIG. 6 on which the charging roller holder 40 is disposed. A shaft of the image carrier 31 is disposed in a hole 39*a* that is formed on the right side wall 39 of the housing 30*a* of FIG. 6.

Referring to FIGS. 6 and 7, an inner surface of the right side wall 39 of the housing 30*a* of the developing cartridge 30 is provided with two guiding members 46 and two supporting members 47 that allow the charging roller holder 40 to perform a sliding motion with respect to the inner surface of the right side wall 39. The two guiding members 46 project inside the housing 30*a* from the inner surface of the right side wall 39 of the housing 30*a* of the developing cartridge 30 and allow the charging roller holder 40 to be spaced apart from and to slidably move with respect to the inner surface of the right side wall 39. The two supporting members 47 are disposed at opposite sides of the two guiding members 46 on the inner surface of the right side wall 39 and support opposite sides 44 and 45 of the front surface of the charging roller holder 40 to prevent the charging roller holder 40 from separating from the two guiding members 46 while the charging roller holder 40 moves slidably. In other words, the front surface of the charging roller holder 40 is supported by the two supporting members 47, and the rear surface of the charging roller holder 40 is supported to slidably move by the two guiding members 46. Accordingly, the charging roller holder 40 may slidably move with respect to the inner surface of the right side wall 39 of the housing 30*a* by the two guiding members 46 and the two supporting members 47.

In addition, a pressure member fixing protrusion 42 to which the pressure member 43 of the charging roller holder 40 is fixed is formed below the two guiding members 46 on the inner surface of the right side wall 39 of the housing 30*a* of the developing cartridge 30. Accordingly, the charging roller holder 40 always receives a pressure toward the image carrier 31 by the pressure member 43.

The charging roller separating unit 50 is disposed in the main body 10 and causes the charging roller 32 to be selectively located in any one of a first position and a second position. Here, the first position refers to a position in which the charging roller 32 is in contact with the image carrier 31 to form a charging nip, and the second position refers to a position in which the charging roller 32 is spaced apart from the image carrier 31.

Figure 5:
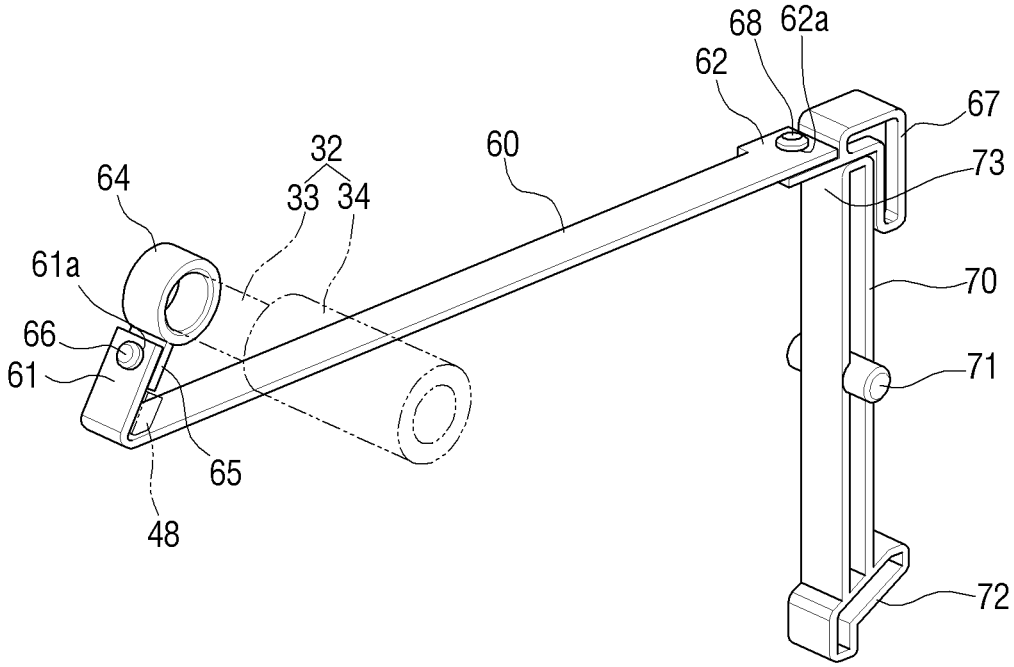
FIG. 5 is a perspective view illustrating the link member hooked to a top end of the lever member of the image forming apparatus of FIG. 2.

The charging roller separating unit 50 may include a link member 60 and a lever member 70. The link member 60 applies a predetermined force to the charging roller 32 so that the charging roller 32 is separated from the image carrier 31. The link member 60 may be formed in a bendable thin band shape. One end 61 of the link member 60 is secured to the charging roller 32. In this embodiment, as illustrated in FIG. 5, a fixing cap 64 is fixed on one end of the shaft 33 of the charging roller 32 and the one end portion 61 of the link member 60 is coupled to the fixing cap 64. For this, a first hooking protrusion 66 is formed on an extension portion 65 of the fixing cap 64, and a first fixing hole 61*a* into which the first hooking protrusion 66 may be inserted is formed on one end portion 61 of the link member 60. If the first hooking protrusion 66 of the fixing cap 64 is inserted into the first fixing hole 61*a* formed on the one end portion 61 of the link member 60, the one end portion 61 of the link member 60 is coupled to the fixing cap 64. At this time, the link member 60 may be formed of a film or an injection molding element manufactured of a flexible material such as urethane rubber.

The movement of the link member 60 coupled to the fixing cap 64 is guided by a direction changing member 48 and a link guiding member 49 that are formed on the inner surface of the right side wall 39 of the housing 30*a* of the developing cartridge 30. The direction changing member 48 is formed to project inside the housing 30*a* below the two guiding members 46 on the inner surface of the right side wall 39 of the housing 30*a* and changes the moving direction of the link member 60 toward the link guiding member 49. The link guiding member 49 is disposed on the inner surface of the right side wall 39 of the housing 30*a* to form a passage 49*a* through which the link member 60 may pass. The passage 49*a* has a predetermined length. A portion of the link member 60 is exposed to the outside of the housing 30*a* of the developing cartridge 30 via the passage 49*a* of the link guiding member 49. A hooking part 67 is formed on an end portion 62 of the link member 60 that is exposed to the outside. The hooking part 67 is formed in a shape to be hooked to the top end of the lever member 70 as will be described below. In this exemplary embodiment, the hooking part 67 is formed in a substantially L shape. A second hooking protrusion 68 is formed on one end portion of the hooking part 67. A second fixing hole 62*a* into which the second hooking protrusion 68 may be inserted is formed on the other end portion 62 of the link member 60. If the second hooking protrusion 68 formed on the one end portion of the hooking part 67 is inserted into the second fixing hole 62*a* formed on the other end portion 62 of the link member 60, the hooking part 67 is coupled to the other end portion 62 of the link member 60. As a result, if a worker pulls the other end portion 62 of the link member 60 to which the hooking part 67 is coupled, a force is applied to the shaft 33 of the charging roller 32 so that the charging roller 32 is spaced apart from the image carrier 31.

In the above description, the structure, which couples the link member 60 to each of the fixing cap 64 and the hooking part 67, uses the hooking protrusions 66 and 68 and the fixing holes 61*a* and 62*a*. However, this does not limit the coupling structure of the link member 60. The link member 60 may be coupled to the fixing cap 64 and/or the hooking part 67 by using various methods such as adhesives, etc. Also, in the above described exemplary embodiment, the link member 60 is fixed to the charging roller 32 using the fixing cap 64. However, as in other exemplary embodiments, the link member 60 may be directly fixed to the shaft 33 of the charging roller 32. Alternatively, the link member 60 may be fixed to the charging roller holder 40.

The lever member 70 is rotatably disposed on a side frame 11 of the main body 10 and may selectively hold the link member 60 dependent on mounting and separating of the paper feeding cassette 20. In this exemplary embodiment, the lever member 70 is disposed on a right frame 11 of the main body 10 so that the link member 60 disposed on the right side wall 39 of the developing cartridge 30 may be hooked to the lever member 70. In another example, the lever member 70 may be disposed on a left frame 12 of the main body 10. In this exemplary embodiment, the link member 60 is disposed on a left side wall of the housing 30*a* of the developing cartridge 30. The structure to support the link member 60 disposed on the left side wall of the housing 30*a* is the same as the structure to support the link member 60 disposed on the right side wall 39 of the housing 39*a*, as is described above. In addition, if the link member 60 is disposed on opposite side walls, namely, both the left side wall and the right side wall 39 of the housing 30*a* of the developing cartridge 30, the lever member 70 also is disposed on both of the left frame 12 and the right frame 11.

Figure 4:
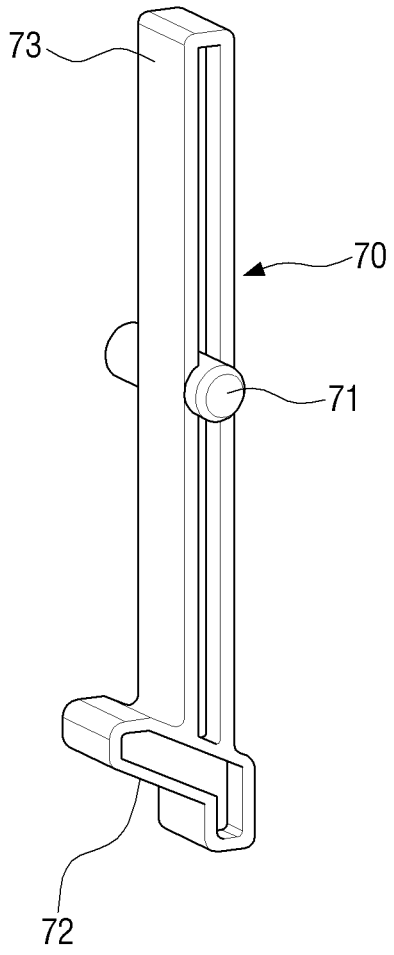
FIG. 4 is a perspective view illustrating the lever member of the image forming apparatus of FIG. 2.

Referring to FIG. 4, a hinge shaft 71 may be inserted into a hinge hole formed on the right frame 11 of the main body 10. The hinge shaft 71 may be formed on the approximately center portion of the lever member 70. An operating portion having a shape corresponding to the lever fixing member 25 of the paper feeding cassette 20 is formed on a bottom end 72 of the lever member 70. A top end 73 of the lever member 70 is formed in a shape to which the hooking part 67 of the link member 60 may be hooked. Also, when force is not applied to the bottom end 72 of the lever member 70, for example, when the bottom end 72 of the lever member 70 is not in contact with the lever fixing member 25 of the paper feeding cassette 20, the lever member 70 may be formed so that the top end 73 of the lever member 70 is rotated toward the charging roller 32 based on the hinge shaft 71. In this exemplary embodiment, when force is not applied to the bottom end 72 of the lever member 70, the lever member 70 is formed to rotate in a clockwise direction. Accordingly, if the lever fixing member 25 of the paper feeding cassette 20 is not in contact with the bottom end 72 of the lever member 70, the top end 73 of the lever member 70 is inclined toward the developing cartridge 30.

Additionally, the lever member 70 is disposed to project above a middle partition wall 17 of the right frame 11. For this, a through hole 18 is formed on the middle partition wall 17. The through hole 18 limits a rotation range of the lever member 70. For example, if the lever fixing member 25 of the paper feeding cassette 20 does not support the bottom end 72 of the lever fixing member 25, the lever member 70 is rotated in the clockwise direction. In this exemplary embodiment, the rotation range of the lever member 70 is limited by the length of the through hole 18.

The rotation of the lever member 70 is controlled by mounting and separating the paper feeding cassette 20 to and from the main body 10 of the image forming apparatus 1. For example, if the paper feeding cassette 20 is mounted to the main body 10 in the folded state, the lever fixing member 25 disposed in the paper feeding cassette 20 fixes the lever member 70 so that the lever member 70 does not rotate with respect to the right frame 11 of the main body 10. In other words, if the folded paper feeding cassette 20 is mounted to the main body 10, as illustrated in FIGS. 1 and 2, the lever fixing member 25 of the paper feeding cassette 20 may interfere with the bottom end 72 of the lever member 70 so that the lever member 70 is fixed perpendicular to the paper feeding cassette 20. On the other hand, if the paper feeding cassette 20 is mounted to the main body 10 in an extended state, for example, in the restored state having a normal size, the lever fixing member 25 of the paper feeding cassette 20 does not interfere with the bottom end 72 of the lever member 70 so that the lever member 70 may rotate freely. In this exemplary embodiment, the lever member 70 rotates by a predetermined angle in the clockwise direction by its own weight. Also, if the paper feeding cassette 20 is separated from the main body 10, the lever fixing member 25 of the paper feeding cassette 20 does not interfere with the bottom end 72 of the lever member 70 so that the lever member 70 may rotate freely with respect to the right frame 11 of the main body 10.

Hereinafter, operation of an image forming apparatus 1 according to an exemplary embodiment of the present general inventive concept having the above-described structure will be explained in detail with reference to accompanying drawings.

First, a case will be explained when the charging roller 32 is spaced apart from the image carrier 31 in the manufacturing process of the image forming apparatus 1 according to an exemplary embodiment of the present general inventive concept.

To test the image forming apparatus 1 assembly which is completed, the worker inserts the developing cartridge 30 into the main body 10 of the image forming apparatus 1, and then performs a test printing. If the image forming apparatus 1 passes the test printing, the worker separates the charging roller 32 of the developing cartridge 30 from the image carrier 31.

Figure 11:
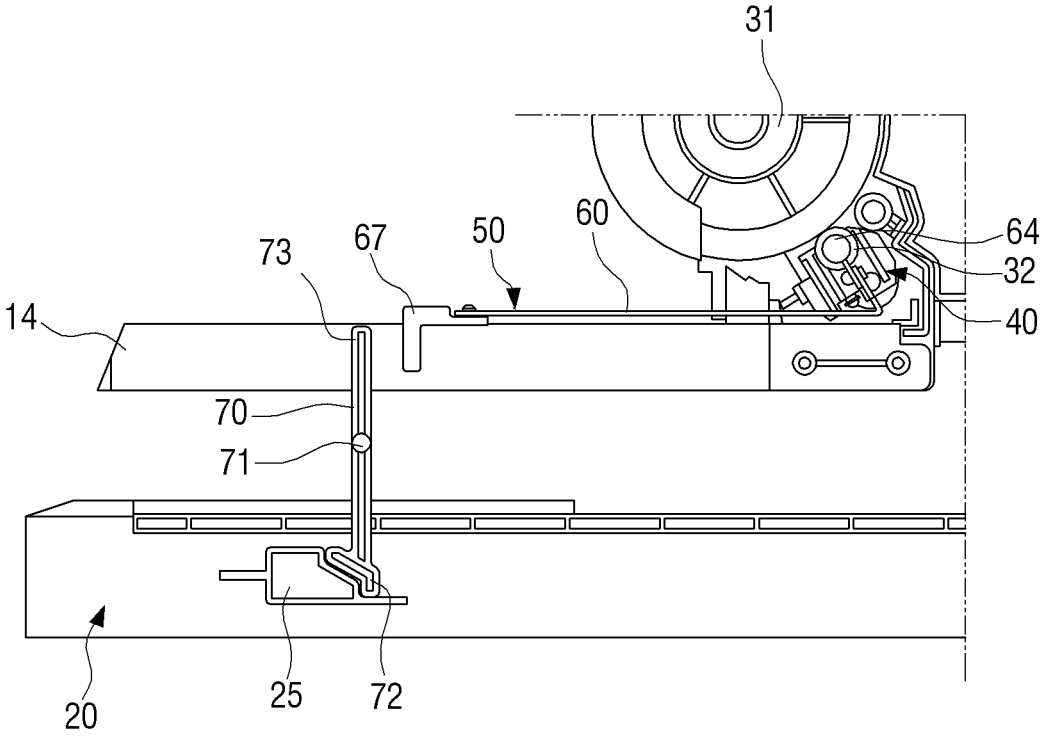
FIG. 11 is a view illustrating a lever member when a folded paper feeding cassette is mounted into an image forming apparatus according to an exemplary embodiment of the present disclosure.

In order to separate the charging roller 32 from the image carrier 31, the worker pulls out the paper feeding cassette 20 from the image forming apparatus 1, and then folds the paper feeding cassette 20 (S10). In other words, if the moving portion 23 of the paper feeding cassette 20 is moved to the stationary portion 21 thereof, and the paper feeding cassette 20 is folded. After that, the worker inserts the folded paper feeding cassette 20 into the cassette space 15 of the main body 10 (S12). Thus, the lever fixing member 25 disposed on one side wall of the paper feeding cassette 20 pushes the bottom end 72 of the lever member 70. When the paper feeding cassette 20 is completely inserted into the main body 10, the lever member 70 is fixed in a state perpendicular to the paper feeding cassette 20 as illustrated in FIG. 11 (S14).

Figure 12:
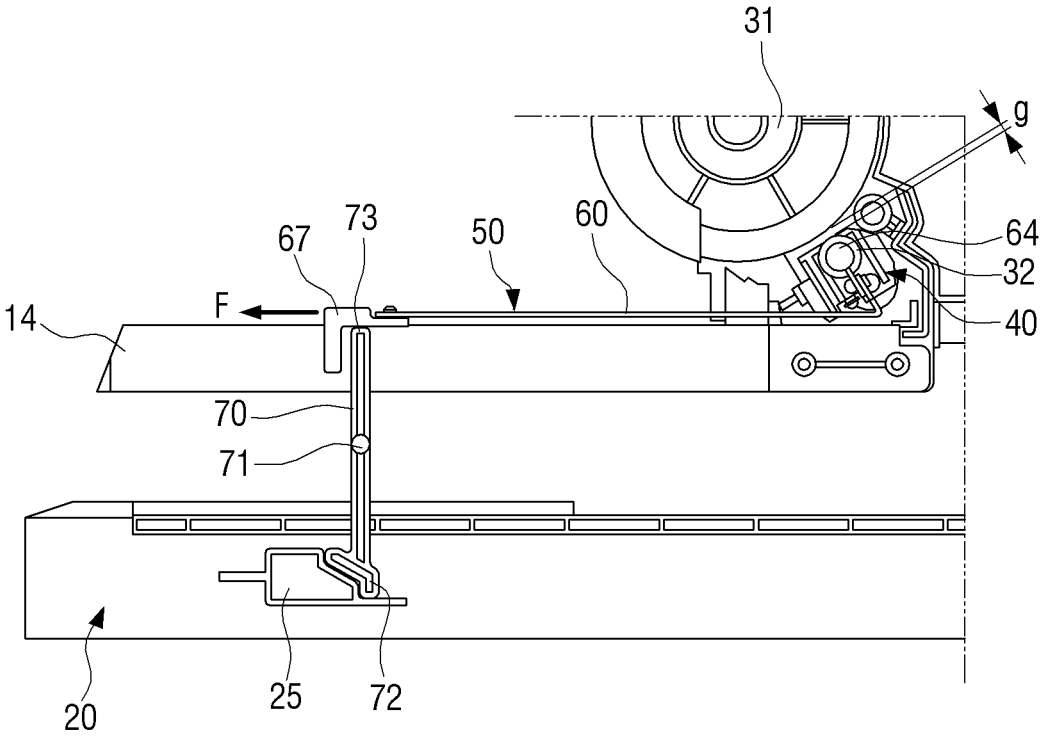
FIG. 12 is a view illustrating when a hooking part of a link member is being hooked to a top end of the lever member of FIG. 11.

Then the worker pulls the hooking part 67 coupled to the one end 62 of the link member 60, and hooks the hooking part 67 to the top end 73 of the lever member 70 (S16). As illustrated in FIG. 12, if the worker pulls the hooking part 67 of the link member 60 in a direction of arrow F, the link member 60 is guided by the link guiding member 49 and the direction changing member 48 disposed on the right side wall 39 of the housing 30*a* of the developing cartridge 30 to move in the left direction. As a result, the fixing cap 64 receives a force from the force applied to the link member 60 so as to move downwardly. As a result, the shaft 33 of the charging roller 32 to which the fixing cap 64 is fixed is moved downwardly so that the charging roller 32 is spaced apart from the image carrier 31 (S18). After that, the image forming apparatus 1 is packaged, and then, marketed.

As described above, if the hooking part 67 of the link member 60 is hooked to the top end 73 of the lever member 70, the image carrier 31 and the charging roller 32 of the developing cartridge 30 remain spaced apart from each other. Therefore, problems such as compression set, migration, etc., may be prevented from occurring.

Next, a case will be explained when a user buys the image forming apparatus 1 according to an exemplary embodiment of the present general inventive concept and uses the purchased image forming apparatus 1.

Figure 10:
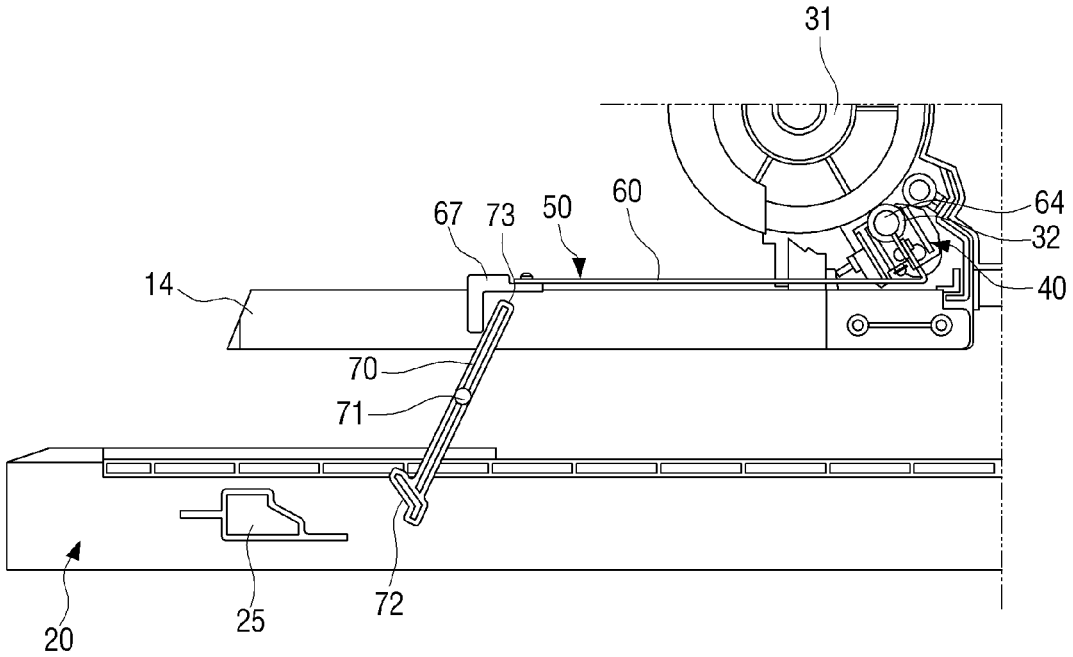
FIG. 10 is a side view illustrating the relationship between a link member and a lever member when a paper feeding cassette is separated from the image forming apparatus of FIG. 1.

In order to load printing media, the user first separates the paper feeding cassette 20 from the main body 10 of the image forming apparatus 1 (S20). At this time, the paper feeding cassette 20 is in a folded state. As illustrated in FIG. 10, when the paper feeding cassette 20 is separated from the main body 10 of the image forming apparatus 1, the lever fixing member 25 disposed on one side wall of the paper feeding cassette 20 is moved in the left direction. Since the force applied to the bottom end 72 of the lever member 70 is removed if the lever fixing member 25 is moved in the left direction, the lever member 70 is rotated in the clockwise direction by its own weight and the link member 60 (S22). As a result, the lever member 70 moves until one end of the through hole 18, and then the hooking part 67 of the link member 60 goes off the top end 73 of the lever member 70 (S24). In other words, since the link member 60 to which the hooking part 67 hooked to the top end 73 of the lever member 70 is coupled moves in the right direction, the force applied to the link member 60 is removed. As a result, the charging roller holder 40 is moved upward by the pressure of the pressure member 43 of the charging roller holder 40 so that the charging roller 32 becomes in contact with the image carrier 31 (S26).

Thereafter, the user extends the separated paper feeding cassette 20, and then loads printing media in the paper feeding cassette 20. In other words, if the user grips the stationary portion 21 of the paper feeding cassette 20, and then, as illustrated in FIG. 8, pulls the moving portion 23 in a direction of arrow C, the paper feeding cassette 20 is extended to be restored to a normal size. For example, if the paper feeding cassette 20 is set for A4 size printing media when the paper feeding cassette 20 is extended, A4-size printing media may be loaded in the paper feeding cassette 20.

Figure 13:
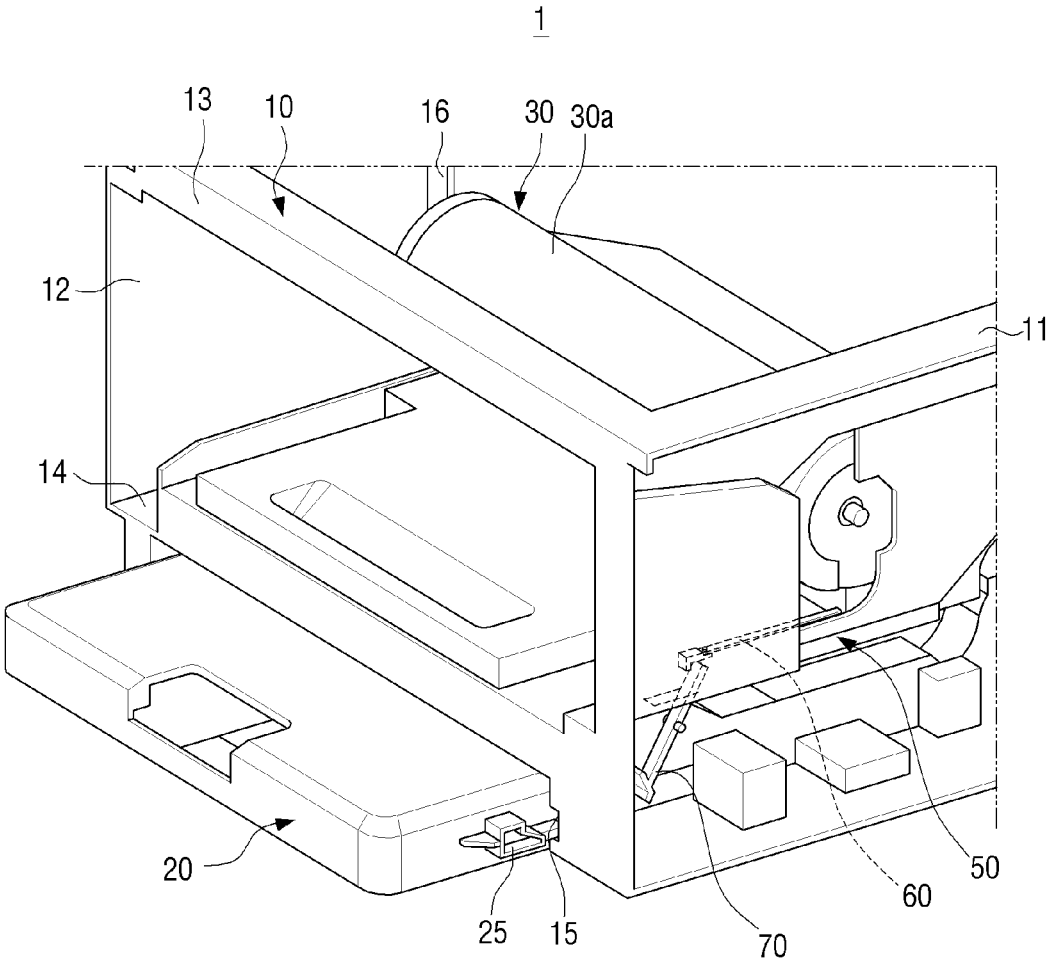
FIG. 13 is a partially perspective view illustrating the image forming apparatus of FIG. 1 into which the extended paper feeding cassette is mounted.
Figure 14:
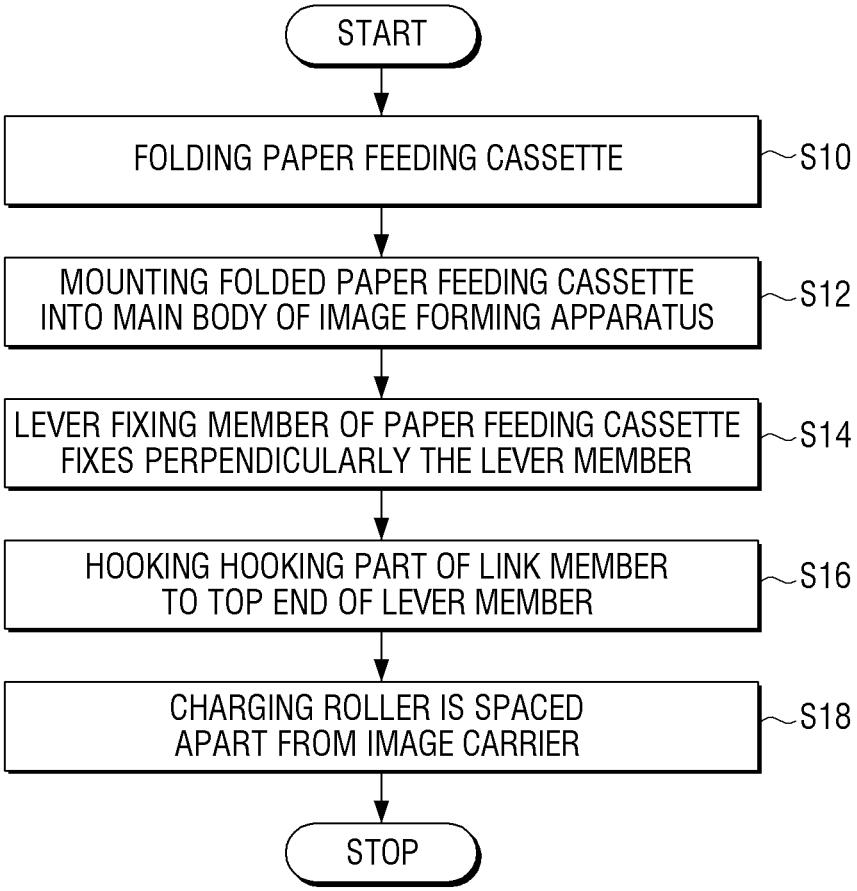
FIG. 14 is a flow chart illustrating a method of separating a charging roller of an image forming apparatus according to an exemplary embodiment of the present general inventive concept.
Figure 15:
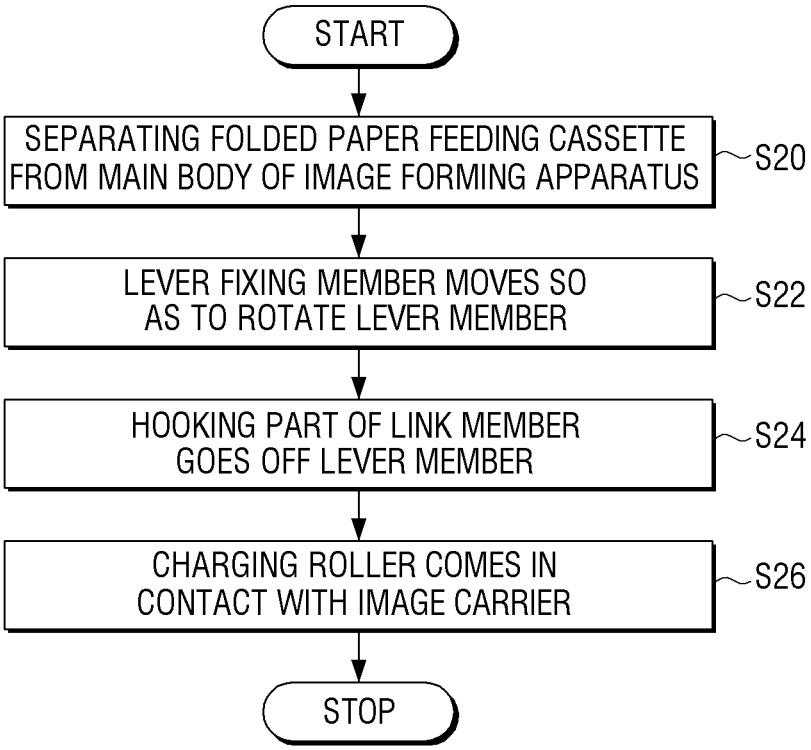
FIG. 15 is a flow chart illustrating a method of contacting a charging roller of an image forming apparatus according to an exemplary embodiment of the present general inventive concept.

Subsequently, as illustrated in FIG. 13, the user inserts the paper feeding cassette 20 in which the printing media are loaded into the cassette space 15 of the main body 10 of the image forming apparatus 1. At this time, as illustrated in FIG. 13, since the lever fixing member 25 disposed on one side wall of the paper feeding cassette 20 is not in contact with the bottom end 72 of the lever member 70, the lever member 70 remains inclined by a certain angle.

As a result, the charging roller 32 of the developing cartridge 30 remains in contact with the image carrier 31. Accordingly, the user uses the image forming apparatus 1 according to an exemplary embodiment of the present general inventive concept to print a desired output.

With the image forming apparatus 1 according to an exemplary embodiment of the present general inventive concept having the above-described structure, in a manufacturing factory of the image forming apparatus 1, after the worker folds the paper feeding cassette 20, mounts the folded paper feeding cassette 20 into the image forming apparatus 1, and hooks the hooking part 67 of the link member 60 to the top end of the lever member 70, the charging roller 32 of the developing cartridge 30 is spaced apart from the image carrier 31. Accordingly, when manufacturing the image forming apparatus 1, it is very convenient that the worker separates the charging roller 32 from the image carrier 31.

Further, with the image forming apparatus 1 according to an exemplary embodiment of the present general inventive concept, if the user who buys the image forming apparatus 1 first loads printing media in the paper feeding cassette 20, the charging roller 32 comes in contact with the image carrier 31 of the developing cartridge 30. In other words, even if the user separates the paper feeding cassette 20 from the main body 10 of the image forming apparatus 1, extends the paper feeding cassette 20 to its original state, loads printing media in the paper feeding cassette 20, and completely mounts the paper feeding cassette 20 into the main body 10 of the image forming apparatus 1, as illustrated in FIG. 13, the lever fixing member 25 disposed on one side wall of the paper feeding cassette 20 does not interfere with the lever member 70. Accordingly, the user is not required to perform a specific action to cause the charging roller 32 to come in contact with the image carrier 31. Therefore, the image forming apparatus 1 according to t least one exemplary embodiment of the present general inventive concept increases convenience to the user.

In the above explanation, the paper feeding cassette 20 has a foldable structure; however, this does not limit the present disclosure. For example, the present disclosure may use a paper feeding cassette having a structure in which the paper feeding cassette may not be folded. In this case, the lever fixing member 25 is disposed on the paper feeding cassette so that if the paper feeding cassette is mounted into the main body 10, the lever fixing member 25 supports the bottom end 72 of the lever member 70 to cause the lever member 70 to be fixed perpendicular to the paper feeding cassette. Then, after a worker and/or a user mounts the paper feeding cassette into the main body 10, if he or she hooks one end of the link member 60 of the developing cartridge 30 to the top end 73 of the lever member 70 that is fixed perpendicular to the paper feeding cassette, the charging roller 32 may be spaced apart from the image carrier 31. Subsequently, if a user separates the paper feeding cassette from the main body 10, the force of the lever member 70 applied to the link member 60 is removed so that the charging roller 32 comes in contact with the image carrier 31 to form a nip. After that, if the paper feeding cassette again is mounted, the lever fixing member 25 disposed on the paper feeding cassette presses the bottom end 72 of the lever member 70 to cause the lever member 70 to be perpendicular to the paper feeding cassette. However, even if the lever member 70 is perpendicular to the paper feeding cassette, if the worker and/or the user does not pull the one end of the link member 60 and does not hook it to the top end of the lever member 70, the charging roller 32 remains in contact with the image carrier 31.

Therefore, when the image forming apparatus 1 is manufactured, the worker hooks the one end of the link member 60 to the top end 73 of the lever member 70 to cause the charging roller 32 to be spaced apart from the image carrier 31. Therefore, the image forming apparatus 1 may be shipped after the user subsequently purchases the image forming apparatus 1, if the user separates the paper feeding cassette from the main body 10 to load printing media in the paper feeding cassette, the charging roller 32 comes in contact with the image carrier 31. After that, even though the user loads printing media in the paper feeding cassette and remounts the paper feeding cassette into the main body 10, the charging roller 32 is not spaced apart from the image carrier 31 and maintains the contact state with the image carrier 31. Accordingly, a user's action of separating and mounting the paper feeding cassette may allow the charging roller 32 to come in contact with, and maintain the contact state with, the image carrier 31.

Although a few exemplary embodiments of the present general inventive concept have been shown and described, it will be appreciated by those skilled in the art that changes may be made in these exemplary embodiments without departing from the principles and spirit of the general inventive concept, the scope of which is defined in the appended claims and their equivalents.

What is claimed is:

1. An image forming apparatus comprising:

a main body of the image forming apparatus;

a developing cartridge that is detachably disposed in the main body and includes an image carrier;

a charging roller that is disposed to face the image carrier in the developing cartridge and charges a surface of the image carrier;

a charging roller separating unit that moves the charging roller between a first position in which the charging roller is in contact with the image carrier and a second position in which the charging roller is spaced apart from the image carrier; and a paper feeding cassette detachably disposed in the main body;

wherein when the paper feeding cassette is first mounted, the charging roller is fixed in the second position by the charging roller separating unit.

2. The image forming apparatus of claim 1, wherein when the paper feeding cassette is separated from the main body or mounted in the main body in a state that the paper feeding cassette does not interfere with the charging roller separating unit, the charging roller is positioned at the first position.

3. The image forming apparatus of claim 1, wherein the charging roller separating unit comprises;

a link member connected to the charging roller; and a lever member that is disposed in the main body so that the link member is hooked to the lever member, and the lever member is rotated by mounting and separating the paper feeding cassette.

4. The image forming apparatus of claim 3, wherein a lever fixing member is disposed on the paper feeding cassette to support a bottom end of the lever member.

5. The image forming apparatus of claim 4, wherein the paper feeding cassette is formed to be foldable.

6. The image forming apparatus of claim 5, wherein when the paper feeding cassette is mounted into the main body in a folded state, the lever fixing member supports the bottom end of the lever member so that the lever member is fixed perpendicular to the paper feeding cassette, and when the paper feeding cassette is mounted into the main body in an extended state, the lever fixing member does not support the lever member so that the lever member freely rotates.

7. The image forming apparatus of claim 3, wherein a hooking part is formed on one end portion of the link member to be hooked to the top end of the lever member, and the other end portion of the link member is fixed to one end of a shaft of the charging roller.

8. The image forming apparatus of claim 7, wherein a fixing cap is disposed on the one end of the shaft of the charging roller, and the other end of the link member is fixed to the fixing cap.

9. The image forming apparatus of claim 3, wherein the developing cartridge supports opposite ends of the charging roller and comprises a charging roller holder to press the charging roller toward the image carrier.

10. The image forming apparatus of claim 9, wherein the charging roller holder further comprises a pressure member.

11. The image forming apparatus of claim 3, wherein a through hole through which the one end of the lever member passes and that limits rotation of the lever member is formed on one side frame of the main body.

12. The image forming apparatus of claim 3, wherein the developing cartridge includes a guiding member that guides movement of the link member.

13. An image forming apparatus comprising:

a main body of the image forming apparatus;

a multi-position charging-developing unit including at least an image carrier and a charging roller, and controlling contact therebetween; and a paper feeding cassette detachably disposed in the main body, the paper feeding cassette arranged to fix the charging roller in a spaced apart position from the image carrier when the paper feeding cassette is first mounted.

14. The image forming apparatus of claim 13, wherein the multi-position charging-developing unit comprises:

a developing cartridge that is detachably disposed in the main body and that includes the image carrier;

a charging roller holder that supports the charging roller in a position that faces the image carrier such that the charging roller charges a surface of the image carrier; and a charging roller separating unit that moves the charging roller between a contact position in which the charging roller is in contact with the image carrier, and the spaced apart position in which the charging roller is spaced apart from the image carrier.

15. The image forming apparatus of claim 14, wherein the charging roller comprises:

a shaft; and a rover portion which is disposed on an outer circumference of the shaft to be in contact with the image carrier.

16. The image forming apparatus of claim 15, wherein opposite ends of the shaft are rotatably supported by the charging roller holder coupled to the developing cartridge.

17. The image forming apparatus of claim 14, wherein the charging roller separating unit comprises a link member to apply a predetermined force to the charging roller to separate the charging roller from the image carrier.

18. The image forming apparatus of claim 14, wherein the charging roller separating unit comprises a lever member that rotates in response to mounting and separating the paper feeding cassette to and from the main body of the image forming apparatus.

19. An image forming apparatus comprising:

a main body of the image forming apparatus;

a multi-position charging-developing unit including at least an image carrier and a charging roller, and a paper feeding cassette interacting with the multi-position charging-developing unit to control contact between the image carrier and charging roller, the paper feeding cassette detachably disposed in the main body, and arranged to fix the charging roller in a spaced apart position from the image carrier when the paper feeding cassette is first mounted.

20. The image forming apparatus of claim 19, wherein the charging roller contacts the image carrier in response to detaching the paper feed cassette from the main body after the first mounting.

21. The image forming apparatus of claim 20, wherein the charging rover remains in contact with the image carrier after remounting the paper feeding cassette.

* * * * *